US010493479B1

(12) United States Patent
Huang

(10) Patent No.: US 10,493,479 B1
(45) Date of Patent: Dec. 3, 2019

(54) ECO-FRIENDLY PUMPING DEVICE USING THE PRINCIPLE OF VACUUM

(71) Applicant: Wei-Lun Huang, New Taipei (TW)

(72) Inventor: Wei-Lun Huang, New Taipei (TW)

( * ) Notice: Subject to any disclaimer, the term of this patent is extended or adjusted under 35 U.S.C. 154(b) by 0 days.

(21) Appl. No.: 16/212,691

(22) Filed: Dec. 7, 2018

(30) Foreign Application Priority Data

Aug. 29, 2018 (TW) ..... 107130127 A

(51) Int. Cl.
*B05B 11/00* (2006.01)

(52) U.S. Cl.
CPC ..... *B05B 11/3067* (2013.01); *B05B 11/3023* (2013.01); *B05B 11/3074* (2013.01); *B05B 11/3076* (2013.01)

(58) Field of Classification Search
CPC ..... B05B 11/3067; B05B 11/3076; B05B 11/3023; B05B 11/3074
USPC ..... 222/321.9
See application file for complete search history.

(56) References Cited

U.S. PATENT DOCUMENTS 5,100,027 A * 3/1992 Gueret ..... A45D 34/04 222/105
6,070,763 A * 6/2000 Gueret ..... B05B 11/0072 222/95
8,167,171 B2 * 5/2012 Moretti ..... B05B 11/0097 222/95
2002/0027146 A1 * 3/2002 de LaForcade .... B65D 21/0223 222/321.9
2004/0112921 A1 6/2004 Nomoto et al.
2004/0124212 A1 * 7/2004 Masuda ..... B05B 11/0013 222/183
2010/0038267 A1 2/2010 Ding
2010/0264166 A1 * 10/2010 Moretti ..... B05B 11/00412 222/105
2011/0220682 A1 * 9/2011 Lim ..... B05B 11/3023 222/183
2016/0368700 A1 * 12/2016 Smith ..... B65D 83/48

FOREIGN PATENT DOCUMENTS

CN 1872632 B 11/2011

* cited by examiner

*Primary Examiner* — Jeremy Carroll
(74) *Attorney, Agent, or Firm* — Maschoff Brennan

(57) ABSTRACT

An eco-friendly pumping device includes a press pumping unit, a bottle, and a replaceable soft bag disposed in the bottle. An opening part of the replaceable soft bag is directly connected to the press pumping unit. The interior of the replaceable soft bag forms a closed space and a negative pressure state simultaneously when operating the press pumping unit because of vacuum effect. A shape and an inner volume of the flexible bag body are squeezed automatically by external air pressure outside because of vacuum effect as the time of use and amount of use increase. The replaceable soft bag can be directly wedged to the press pumping unit to replace an empty one, so that the fluid material in the replaceable soft bag does not need to be poured and transferred into the bottle, and the fluid material does not contact with hands.

8 Claims, 6 Drawing Sheets

ECO-FRIENDLY PUMPING DEVICE USING THE PRINCIPLE OF VACUUM

CROSS-REFERENCE TO RELATED PATENT APPLICATION

This application claims the benefit of priority to Taiwan Patent Application No. 107130127, filed on Aug. 29, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a pumping device, and more particularly to an eco-friendly pumping device using the principle of vacuum.

BACKGROUND OF THE DISCLOSURE

Everyday necessities such as shampoo, shower gel, and dishwashing liquid are mostly bottled, and have a dispensing head disposed over the bottle opening to draw out the fluid in the bottle by pressing for use. While such a way of extracting the fluid is convenient, some of the fluid will still remain at a bottom of the bottle and cannot be used completely even if the consumer would like to draw out the fluid material. In addition, the bottle and the dispensing head are typically discarded without recycling resulting in waste. Further, the fluid remaining in the bottle can also seriously harm the environment.

With the recent rise of environmental awareness, how such materials can be reused has become an important issue. Therefore, refill packages for everyday necessities such as shampoo, shower gel, and dishwashing liquid can now be found on the market to reduce waste of the containers. However, the refilling process, i.e. transferring the replacement material in the refill packages into the bottle, requires a lot of work and time, and the fluid may easily smear onto the hands making a mess everywhere and even harming the environment when the fluid of the refill packages is transferred into the bottle. This results in a lot of water being needed to wash away the smeared fluid, which can be quite inconvenient. Furthermore, the refill packages may also contain residual fluid becoming hard to recycle, or may pollute the environment due to littering.

SUMMARY OF THE DISCLOSURE

In response to the above-referenced technical inadequacies, the present disclosure provides an environmental-protection pumping device using the principle of vacuum, and components are able to be reused without harming the environment. In addition, the fluid material can be completely used without leaving any residue and is not wasted, which does not cause any environmental burden and increases the eco-friendliness and operating efficiency of the replaceable soft bag.

In one aspect, the present disclosure provides an eco-friendly pumping device using the principle of vacuum, which includes a press pumping unit, a replaceable soft bag, and a bottle. The press pumping unit includes a dispensing head, a pump cylinder and a duct. The dispensing head is connected to a top end of the pump cylinder. The duct is connected to a bottom end of the pump cylinder. A cap is disposed close to a top end of the pump cylinder. The pump cylinder has at least one first fastening portion formed thereon. The replaceable soft bag has a flexible bag body, and an opening part is formed on a top end of the flexible bag body. The flexible bag body is filled with fluid material. The opening part has at least one second fastening portion formed thereon. The pump cylinder of the press pumping unit is inserted in the opening part of the replaceable soft bag, so as to seal the opening part of the replaceable soft bag, and forms a closed space in an interior of the replaceable soft bag. The interior of the replaceable soft bag is capable of being in a negative pressure state simultaneously when operating the dispensing head because of vacuum effect, and the shape and an inner volume of the flexible bag body is squeezed automatically by the external air pressure outside because of vacuum effect as time of use and amount of use increase. The first fastening portion and the second fastening portion are fastened to each other, so that the replaceable soft bag is fastened to the press pumping unit, and the duct extends into the replaceable soft bag. The bottle has a bottle lip formed on a top end thereof, and the replaceable soft bag is disposed in the bottle. The cap of the press pumping unit is connected to the bottle lip of the bottle. When the dispensing head of the press pumping unit is pressed, the pump cylinder is capable of producing a drawing force, and the interior of the replaceable soft bag forms a negative pressure state, so that the fluid material is capable of being outputted through the duct by a vacuum effect.

Therefore, the instant disclosure has advantages as follows.

The press pumping unit and the bottle of the present disclosure are reusable, and do not cause environmental issues. An interior of the replaceable soft bag can be squeezed by the external air pressure outside the replaceable soft bag by a vacuum effect as the time of use and amount of use increase. In addition, the force of gravity causes the fluid material to fall toward the inner bottom of the replaceable soft bag, so that the fluid material can be outputted through the duct by the vacuum principle, and no residual fluid material remains in the replaceable soft bag. The fluid material can be used completely without resulting in any waste or environmental burden.

Further, according to the present disclosure, the replaceable soft bag can be directly connected to the press pumping unit in a fastening manner to replace an empty one, so that the fluid material in the replaceable soft bag does not need to be poured and transferred into the bottle, and the fluid material does not contact with hands. The replaceable soft bag of the present disclosure is easy and convenient to assemble and replace, increasing the eco-friendliness and operating efficiency of the replaceable soft.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1A:
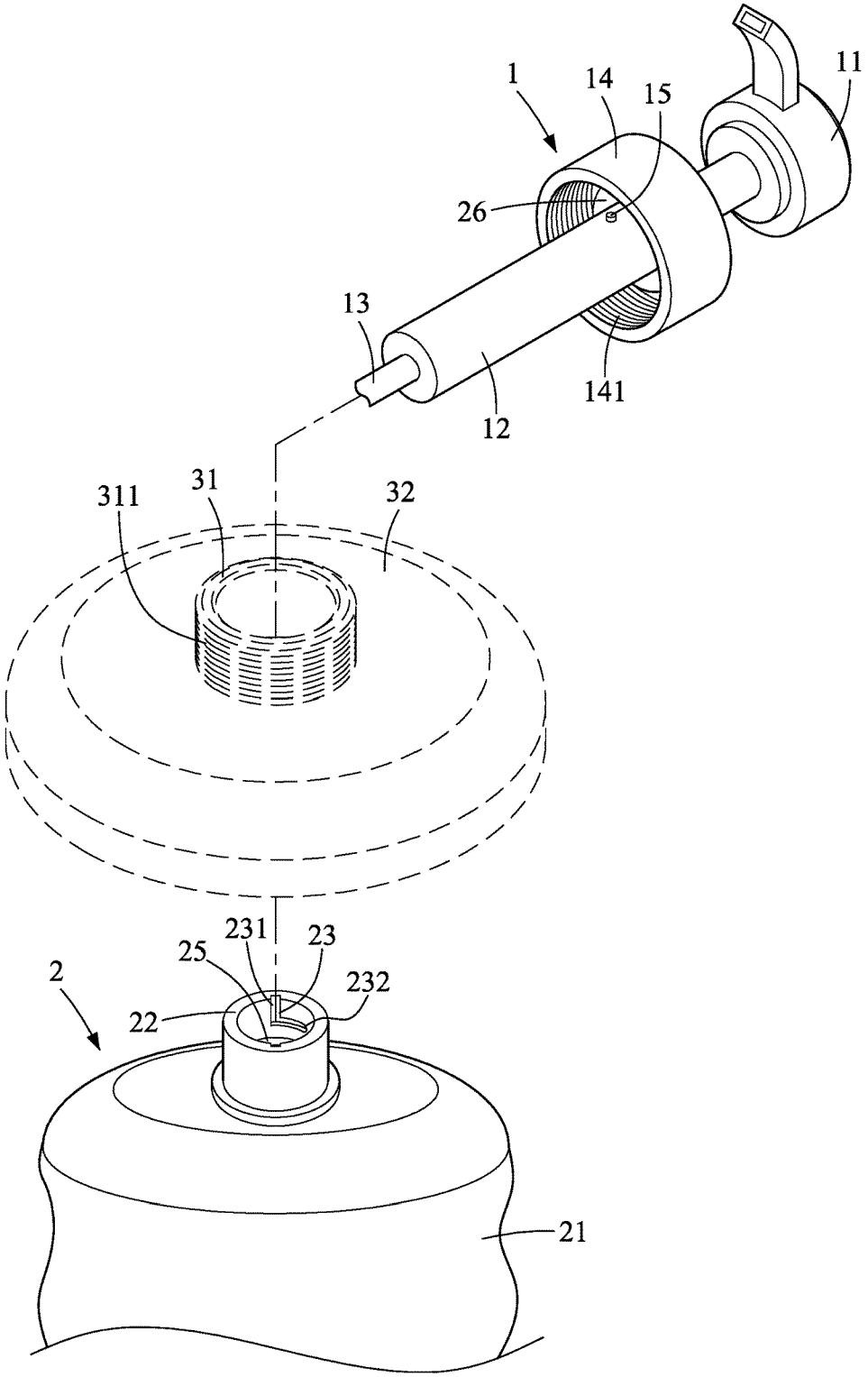
FIG. 1*a* is a partial-exploded view of an eco-friendly pumping device using the principle of vacuum of one embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Reference is made to FIG. 1*a* to FIG. 3. The present disclosure provides an eco-friendly pumping device using the principle of vacuum, which includes a press pumping unit 1, a replaceable soft bag 2 and a bottle 3.

The press pumping unit 1 includes a dispensing head 11, a pump cylinder 12 and a duct 13. The dispensing head 11 is connected to a top end of the pump cylinder 12. The duct 13 is connected to a bottom end of the pump cylinder 12. The pump cylinder 12 can be cylinder-shaped. The duct 13 is a hollow pipe. When the dispensing head 11 is pressed, the pump cylinder 12 provides a drawing force. Therefore, the duct 13 can suck up a fluid material, and the fluid material can pass through the duct 13, the pump cylinder 12 and the dispensing head 11, to then be outputted outward.

A cap 14 is disposed around a top end of the pump cylinder 12. The cap 14 has a first screw thread 141. The first screw thread 141 can be an inner thread or female thread to allow the cap 14 to be screwed to the bottle 3. The press pumping unit 1 is a device used to pump a fluid material by pressing, whose structure can be available in the conventional art, and is not emphasized in the present disclosure. In addition, the structure of the press pumping unit 1 of the present disclosure is not limited.

The pump cylinder 12 is formed with at least one first fastening portion 15, which can be used to fasten to at least one second fastening portion 23 of the replaceable soft bag 2. In this embodiment, the first fastening portion 15 is formed on an outer surface of the pump cylinder 12. The first fastening portion 15 can be a wedging protrusion, and can preferably be more than one, for example, two or three.

The replaceable soft bag 2 has a flexible bag body 21. The flexible bag body 21 is made of waterproof and flexible material. The flexible bag body 21 has an opening part 22 formed on a top end thereof. The opening part 22 is a hollow cylinder. The opening part 22 is connected to an interior of the flexible bag body 21. The flexible bag body 21 can be filled with fluid material, such as shampoo, shower gel and dishwashing liquid. The kind of the fluid material is not limited. Before the replaceable soft bag 2 is assembled to the press pumping unit 1 and the bottle 3, the opening part 22 can be sealed with a sealing lid or sealing plate (not shown), so as to prevent the fluid material in the flexible bag body 21 from flowing out and so that the flexible bag body 21 can be conveniently transported and stored.

The opening part 22 is formed with at least one second fastening portion 23, which can be used to fasten to the first fastening portion 15 of the press pumping unit 1. In this embodiment, the second fastening portion 23 is formed on an inner surface of the opening part 22. The second fastening portion 23 can be a wedging groove, and can preferably be more than one, for example, two or three. The second fastening portion 23 of this embodiment has a first groove 231 and a second groove 232. The first groove 231 extends downward from an upper end of the opening part 22, and one end of the second groove 232 is connected to a lower end of the first groove 231. The second groove 232 extends along a circumferential direction of the opening part 22, and is perpendicular to the first groove 231, so that the second fastening portion 23 is formed as an L-shaped wedging groove (as shown in FIG.

The replaceable soft bag 2 can be connected to the press pumping unit 1 in a fastening manner. In other words, the pump cylinder 12 of the press pumping unit 1 can be inserted in the opening part 22 of the replaceable soft bag 2. Then, the first fastening portion 15 can move downward along the first groove 231 of the second fastening portion 23. When the first fastening portion 15 moves to a lower endpoint of the first groove 231, the press pumping unit 1 and replaceable soft bag 2 are rotatable, and the first fastening portion 15 enters the second groove 232. Finally, the first fastening portion 15 moves to another endpoint of the second groove 232 and is fixed. The replaceable soft bag 2 is therefore fastened and fixed to the press pumping unit 1, and the duct 13 enters into the replaceable soft bag 2. The lower end of the duct 13 is close to a bottom wall of the replaceable soft bag 2. Preferably, a gap G between the bottom end of the duct 13 and the bottom wall of the replaceable soft bag 2 is 1 mm to 10 mm.

Figure 1B:
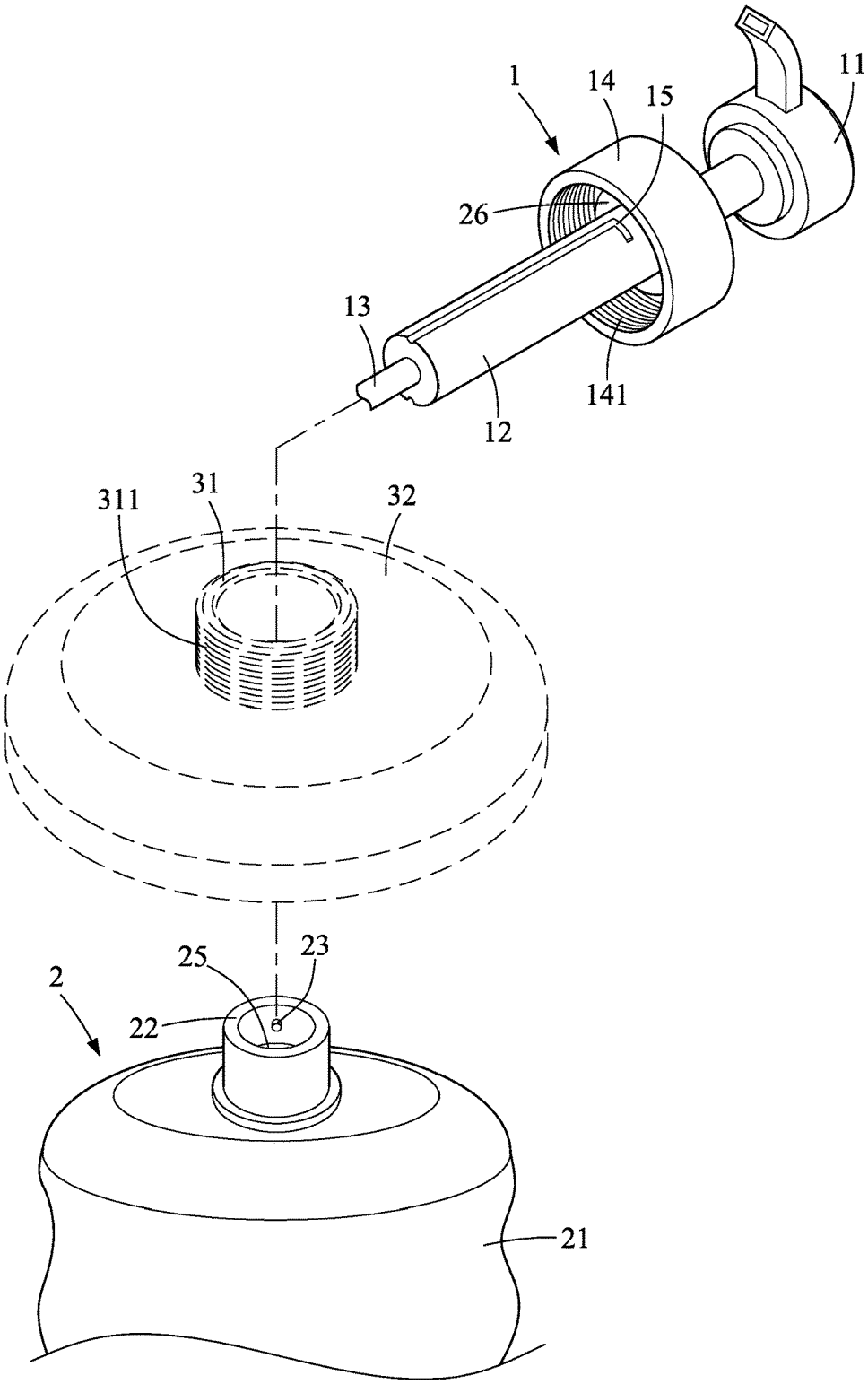
FIG. 1*b* is a partial-exploded view of an eco-friendly pumping device using the principle of vacuum of one embodiment of the present disclosure.
Figure 1C:
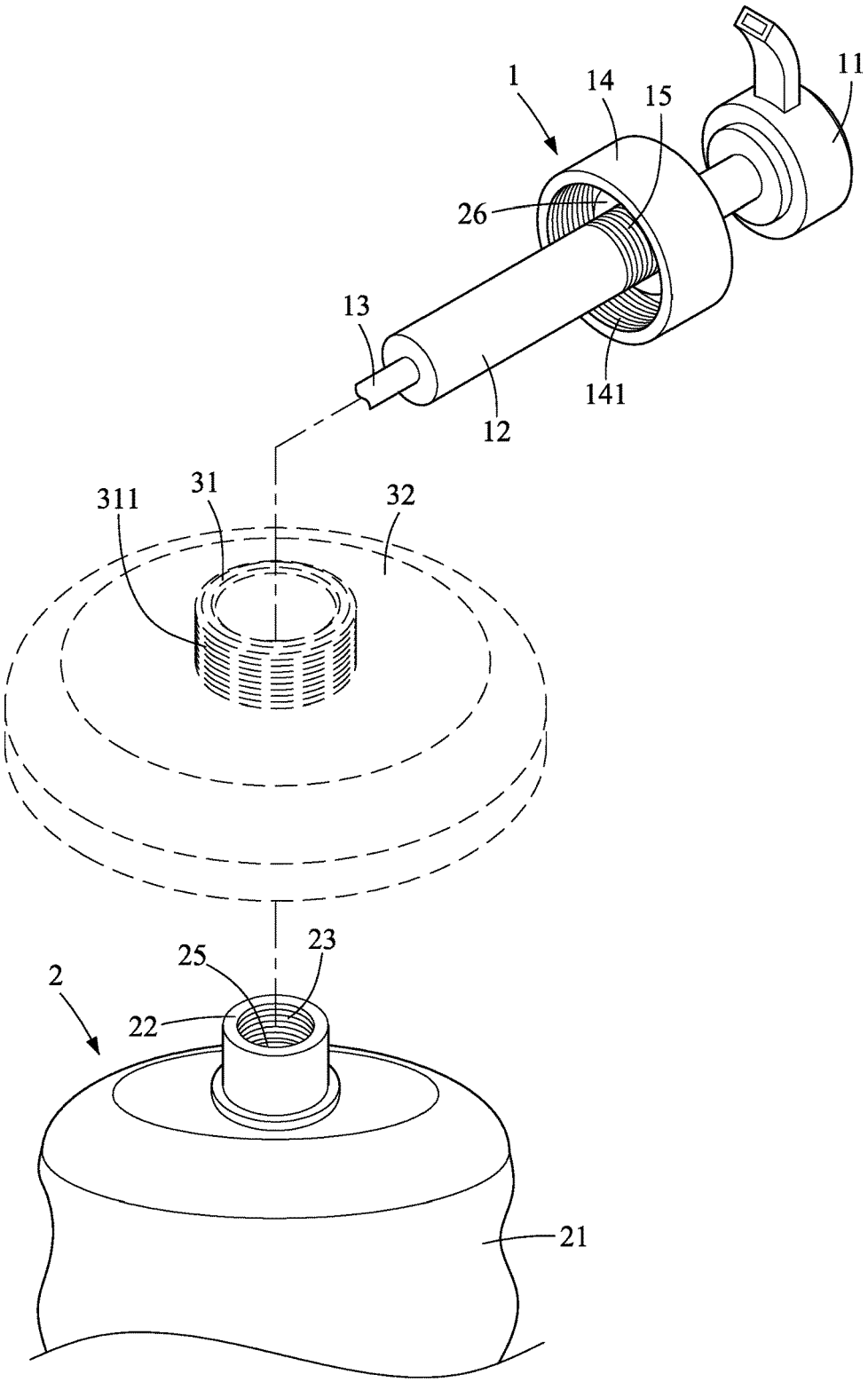
FIG. 1*c* is a partial-exploded view of an eco-friendly pumping device using the principle of vacuum of one embodiment of the present disclosure.
Figure 2:
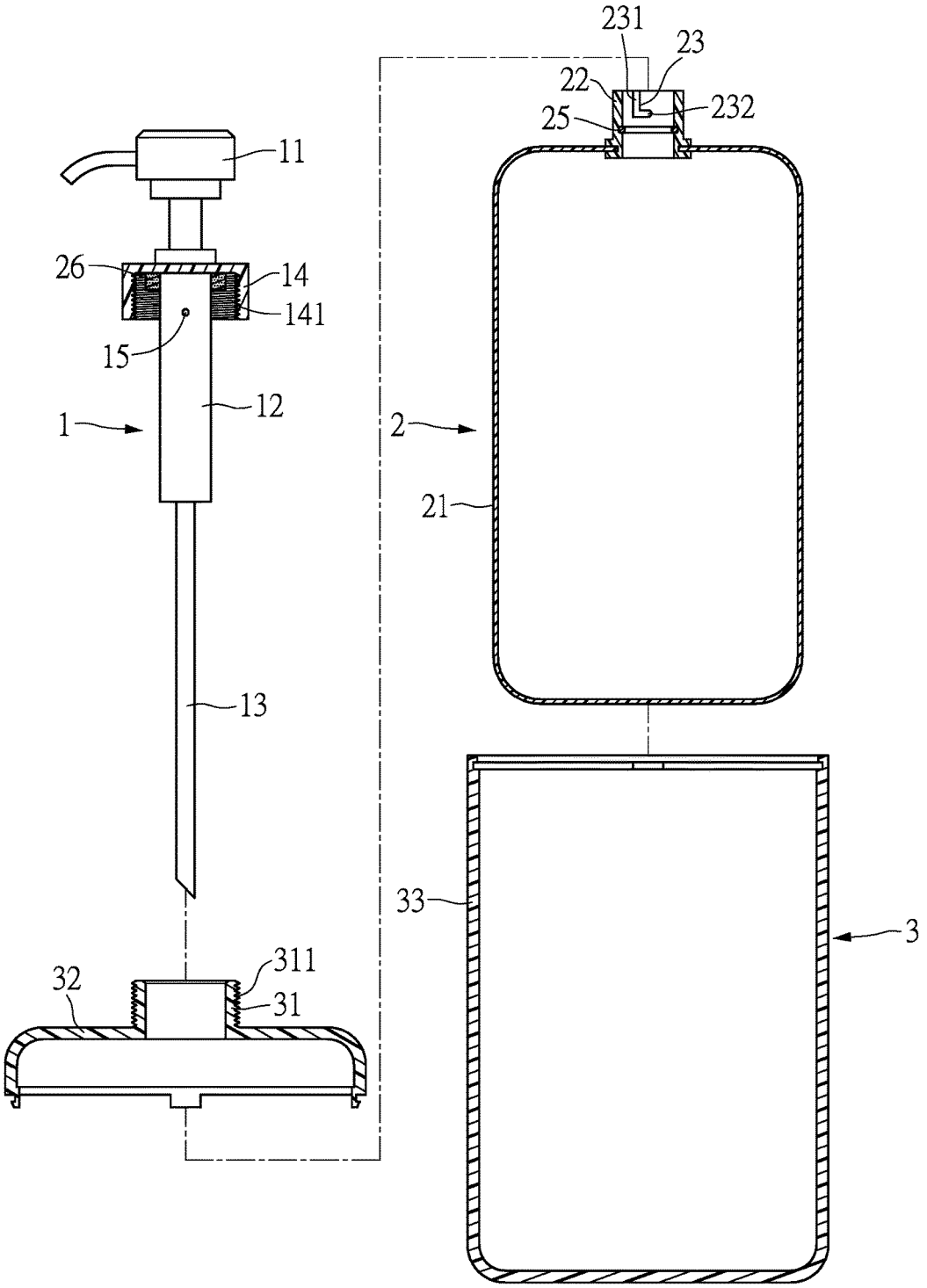
FIG. 2 is a cross-sectional exploded view of the eco-friendly pumping device using the principle of vacuum of the present disclosure.
Figure 3:
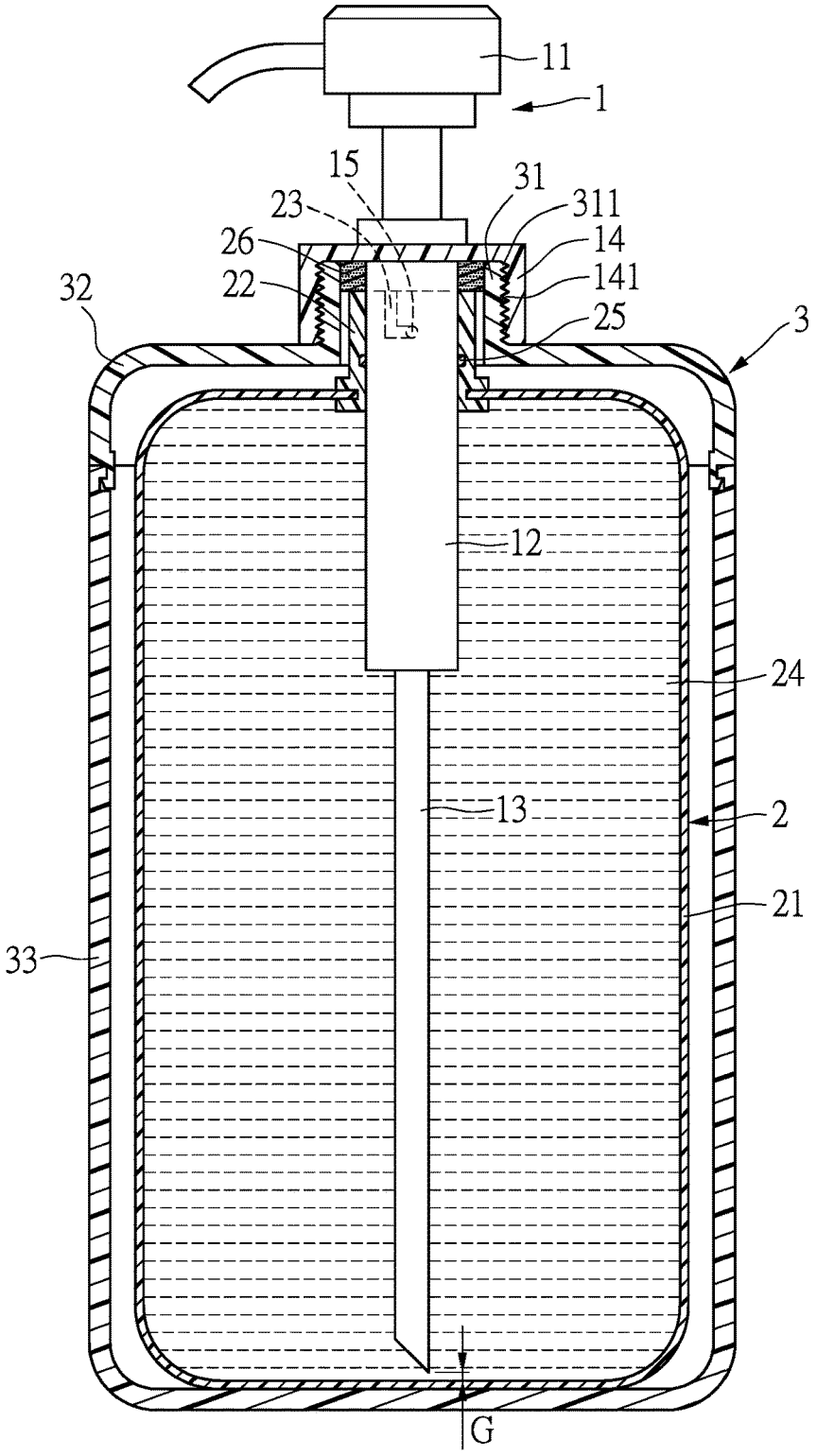
FIG. 3 is a cross-sectional assembled view of the eco-friendly pumping device using the principle of vacuum of the present disclosure.

However, the first fastening portion 15 and the second fastening portion 23 of the present disclosure are not limited thereto, and can be other available fastening structures. For example, the first fastening portion 15 can be an L-shaped wedging groove, and the second fastening portion 23 can be a wedging protrusion, so that the first fastening portion 15 and second fastening portion 23 can be fastened to each other (as shown in FIG. 1*b*). The first fastening portion 15 can be various protruding or concave structures, and the second fastening portion 23 can be various concave or protruding structures correspondingly, which allows the first fastening portion 15 and the second fastening portion 23 to be fastened to each other. The first fastening portion 15 could be with a screw thread structure, and the second fastening portion 23 could be with a screw thread structure, both of which are the concave or protruding structures allowing the first fastening portion 15 and the second fastening portion 23 to be fastened to each other, as shown in FIG. 1*c*.

The replaceable soft bag 2 is fastened and connected to the press pumping unit 1. The pump cylinder 12 of the press pumping unit 1 is inserted in the opening part 22 of the replaceable soft bag 2, and the opening part 22 of the replaceable soft bag 2 can be sealed, so that an interior of the replaceable soft bag 2 forms a closed space 24. The interior of the replaceable soft bag 2 can therefore be in a negative pressure state because of the vacuum effect, and the shape and the inner volume of the flexible bag body 21 shrink as the time of use and amount of use increase. When the dispensing head 11 of the press pumping unit 1 is pressed, the pumping force produced by the pump cylinder 12 can cause the interior of the replaceable soft bag 2 to be in a negative pressure state, so that the fluid material can be drawn out through the duct 13.

To increase the sealing effectiveness of the closed space 24 of the replaceable soft bag 2, at least one first sealing element 2 can be disposed between the opening part 22 of the replaceable soft bag 2 and the pump cylinder 12 of the press pumping unit 1. The first sealing element 25 is disposed between an inner surface of the opening part 22 of the replaceable soft bag 2 and an outer surface of the pump cylinder 12 of the press pumping unit 1, so that the opening part 22 of the replaceable soft bag 2 tightly contacts the pump cylinder 12 of the press pumping unit 1, which can prevent external air from entering the closed space 24 of the replaceable soft bag 2. The closed space 24 of the replaceable soft bag 2 can be maintained in a state of negative pressure during use. The press pumping unit 1 is directly assembled with the replaceable soft bag 2, so as to provide a better airtightness between the press pumping unit 1 and replaceable soft bag 2.

The bottle 3 is a hollow container for receiving the replaceable soft bag 2. A top end of the bottle 3 has a bottle lip 31, and the bottle lip 31 is opened. The bottle lip 31 is fluidly connected with the interior of the bottle 3. The bottle lip 31 has a second screw thread 311, and the second screw thread 311 can be an outer thread. The first screw thread 141 and the second screw thread 311 are screwed together, so that the cap 14 can be connected to the bottle lip 31 of the bottle 3 in a screwing manner. According to another embodiment of the present disclosure, the cap 14 can be connected to the bottle lip 31 of the bottle 3 in a wedging manner.

The replaceable soft bag 2 is disposed in the bottle 3. For allowing the replaceable soft bag 2 to be conveniently put into the bottle 3, the bottle 3 of this embodiment has a two-piece design. In other words, the bottle 3 has an upper housing 32 and a lower housing 33. The upper housing 32 and the lower housing 33 can be assembled together in a wedging or screwing manner, so that the replaceable soft bag 2 can be easily disposed in the bottle 3.

In addition, the replaceable soft bag 2 has at least one second sealing element 26 which is disposed on the opening part 22. The second sealing element 26 is disposed among the opening part 22 of the replaceable soft bag 2, the pump cylinder 12 of the press pumping unit 1, the cap 14, and the bottle lip 31 of the bottle 3. The second sealing element 26 can cooperate with the first sealing element 25 to provide a double sealing effect, so as to maintain the closed space 24 of the replaceable soft bag 2 in a state of negative pressure during use.

According to the eco-friendly pumping device of the present disclosure, an interior of the replaceable soft bag 2 can be squeezed automatically by an external air pressure outside the replaceable soft bag 2 because of the vacuum effect. In other words, when the dispensing head 11 of the press pumping unit 1 is pressed, the interior of the replaceable soft bag 2 is vacuumed and the press pumping unit 1 does not resupply air, so as to draw out the fluid material in the replaceable soft bag 2 by a vacuum principle. When the fluid material in the replaceable soft bag 2 is emptied, it can be replaced with another new replaceable soft bag 2 filled with fluid material for continuous use.

Figure 4:
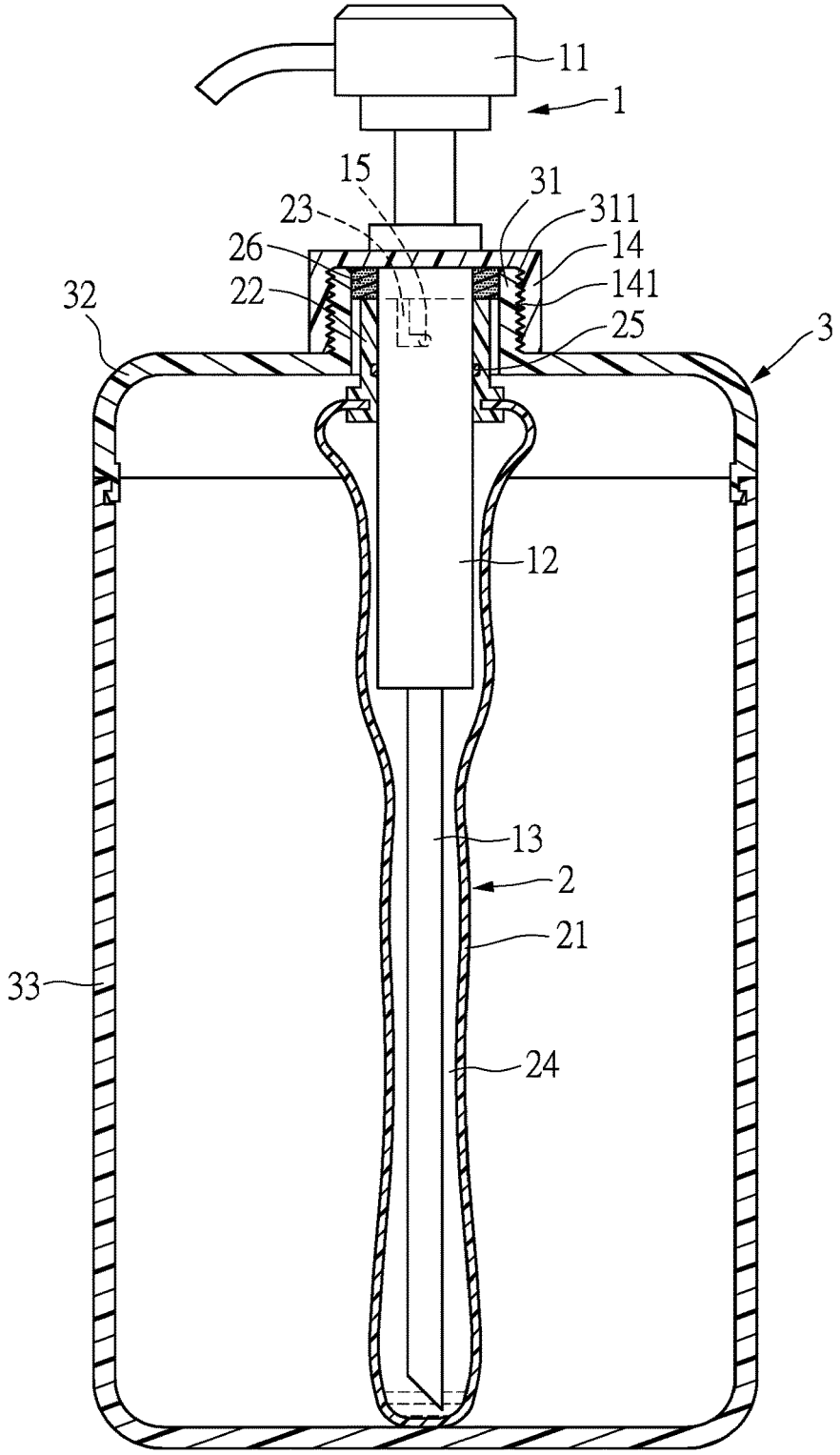
FIG. 4 is another cross-sectional assembled view of the eco-friendly pumping device using the principle of vacuum of the present disclosure.

In conclusion, the press pumping unit 1 and the bottle 3 of the present disclosure are reusable, and do not cause environmental issues. In addition, the force of gravity causes the fluid material to fall toward the inner bottom of the replaceable soft bag 2, and the vacuum principle causes the fluid material to be outputted through the duct 13 so that no residual fluid material remains in the replaceable soft bag 2. The fluid material can be used completely (as shown in FIG. 4) without any being wasted, and does not cause an environmental burden.

Further, according to the present disclosure, the fluid material in the replaceable soft bag 2 does not need to be poured into the bottle 3, and the fluid material does not contact the hands. The replaceable soft bag 2 is connected to the press pumping unit 1 in a fastening manner, so that it can be easily and conveniently assembled and replaced, and the eco-friendliness and operating efficiency of the replaceable soft bag can be increased.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An eco-friendly pumping device using a principle of vacuum, comprising:

a press pumping unit including a dispensing head, a pump cylinder and a duct, the dispensing head being connected to a top end of the pump cylinder, the duct being connected to a bottom end of the pump cylinder, a cap being disposed close to a top end of the pump cylinder, and the pump cylinder having at least one first fastening portion radially formed on a radially external circumferential surface of the pump cylinder;

a replaceable soft bag including a flexible bag body and an opening part formed on a top end of the flexible bag body, the flexible bag body being filled with fluid material, the opening part having at least one second fastening portion radially formed on a radially internal circumferential surface of the opening part, wherein the pump cylinder of the press pumping unit is inserted in the opening part of the replaceable soft bag, so as to seal the opening part of the replaceable soft bag, and forms a closed space in an interior of the replaceable soft bag; wherein the interior of the replaceable soft bag is capable of being in a negative pressure state simultaneously when operating the dispensing head because of vacuum effect, and the shape and an inner volume of the flexible bag body is squeezed automatically by external air pressure outside because of vacuum effect as the time of use and amount of use increase; wherein the first fastening portion of the pump cylinder and the second fastening portion of the opening part are fastened to each other in a radial direction of the pump cylinder by relatively moving the first fastening portion and the second fastening portion along an axial direction of the pump cylinder and relatively rotating the first fastening portion and the second fastening portion about the axial direction of the pump cylinder, so that the replaceable soft bag is fastened to the press pumping unit, and the duct extends into the replaceable soft bag; and a bottle having a bottle lip formed on a top end thereof, the replaceable soft bag being disposed in the bottle, and the cap of the press pumping unit being connected to the bottle lip of the bottle;

wherein when the dispensing head of the press pumping unit is pressed, the pump cylinder is capable of producing a drawing force, and the interior of the replaceable soft bag forms a negative pressure state, so that the fluid material is capable of being outputted through the duct by the vacuum effect.

2. The eco-friendly pumping device according to claim 1, wherein the first fastening portion is a wedging protrusion, and the second fastening portion is a wedging groove.

3. The eco-friendly pumping device according to claim 2, wherein the opening part of the replaceable soft bag is a hollow cylinder, and the pump cylinder of the press pumping unit is cylinder-shaped, wherein the second fastening portion includes a first groove and a second groove, the first groove extends downward from an upper end of the opening part, one end of the second groove is connected to a lower end of the first groove, the second groove extends along a circumferential direction of the opening part, and the second groove is perpendicular to the first groove; such that the first fastening portion is capable of moving downward along the first groove of the second fastening portion, the press pumping unit and the replaceable soft bag are rotatable, the first fastening portion enters the second groove, and the first fastening portion moves to another endpoint of the second groove and is fixed.

4. The eco-friendly pumping device according to claim 1, wherein a gap between a bottom end of the duct and a bottom wall of the replaceable soft bag is 1 mm to 10 mm.

5. The eco-friendly pumping device according to claim 1, wherein at least one first sealing element is disposed between the opening part of the replaceable soft bag and the pump cylinder of the press pumping unit, so that the opening part of the replaceable soft bag tightly contacts the pump cylinder of the press pumping unit.

6. The eco-friendly pumping device according to claim 5, wherein at least one second sealing element is disposed on the opening part of the replaceable soft bag, the second sealing element is disposed among the opening part of the replaceable soft bag, the pump cylinder of the press pumping unit, the cap, and the bottle lip of the bottle.

7. The eco-friendly pumping device according to claim 1, wherein the cap has a first screw thread, the bottle lip has a second screw thread, the first screw thread and the second screw thread are screwed together, so that the cap is connected to the bottle lip of the bottle in a screwing manner.

8. The eco-friendly pumping device according to claim 1, wherein the bottle has an upper housing and a lower housing, and the upper housing and the lower housing are assembled together.

* * * * *